United States Patent [19]

Otsuka et al.

[11] Patent Number: 4,828,420

[45] Date of Patent: May 9, 1989

[54] INTERDENTAL TOOTH CLEANING APPLIANCE

[75] Inventors: Masasuke Otsuka; Sumio Kuriyama, both of Tokyo; Hideyo Maniwa, Yokohama, all of Japan

[73] Assignee: Nippon Shiken Kogyo Co., Ltd., Tokyo, Japan

[21] Appl. No.: 174,415

[22] Filed: Mar. 25, 1988

[30] Foreign Application Priority Data

May 30, 1987 [JP] Japan ..... 62-85048[U]

[51] Int. Cl.[4] ..... A46B 11/02; A46B 9/04

[52] U.S. Cl. ..... 401/268; 401/284; 128/62 A; 15/167.2; 15/206; 15/159 A; 132/329; D4/105

[58] Field of Search ..... 401/284, 286, 268; 15/159 A, 162, 164, 167.1, 167.2, 110, 160, 206; 132/89, 93, 321, 329; 128/62 A; D4/104, 105, 106, 111, 112, 133; D28/64

[56] References Cited

U.S. PATENT DOCUMENTS

| | | | |
|---|---|---|---|
| 596,450 | 12/1897 | Allen | 401/284 X |
| 2,189,175 | 2/1940 | Jackson | 15/167.1 X |
| 2,321,265 | 6/1943 | Ulvick | 401/284 X |
| 3,636,947 | 1/1972 | Balamuth | 128/62 A |
| 3,698,405 | 10/1972 | Walker | 15/159 A |
| 3,939,520 | 2/1976 | Axelsson | 15/167.1 |
| 4,268,933 | 5/1981 | Papas | 15/167.1 |
| 4,517,701 | 5/1985 | Stanford, Jr. | 15/167.1 X |

FOREIGN PATENT DOCUMENTS

| | | | |
|---|---|---|---|
| 771795 | 7/1934 | France | 15/167.1 |
| 8201126 | 4/1982 | PCT Int'l Appl. | 132/89 |

*Primary Examiner*—Richard J. Apley
*Assistant Examiner*—David J. Bender
*Attorney, Agent, or Firm*—Holman & Stern

[57] ABSTRACT

Disclosed is an interdental tooth cleaning appliance for use in cleaning a space formed between adjacent teeth. In order to clean more effectively as compared with a known appliance, the cross-sectional shape of the bristles as seen in a plane perpendicular to the longitudinal axis of the brush is such as to provide three circumferentially spaced groups of bristles which are longer than the remaining bristles. The interdental tooth cleaning appliance of this invention is provided with a guide which makes it a more convenient one. It also has a device for injecting a liquid medicine.

5 Claims, 3 Drawing Sheets

INTERDENTAL TOOTH CLEANING APPLIANCE

BACKGROUND OF THE INVENTION

1. Field of the Invention

The present invention relates to a dental tooth brush used for cleaning teeth, and, more particularly, to an improvement of a cleaning appliance used to clean spaces between teeth, i.e., interdental spaces, which is called an interdental tooth brush or an ID brush (hereinafter referred to as an interdental tooth brush).

2. Description of the Prior Art

Cleaning of the tooth surfaces with a dental tooth brush has been widely practiced as an effective method of preventing the diseases associated with teeth, such as carious tooth and periodontal disease, hindering the progress of these diseases or healing them. The dental tooth brush enables the surfaces of the tooth surfaces, i.e., labial or buccal surfaces and lingual surfaces, to be cleaned, but fail to clean the spaces between teeth, i.e., the interdental spaces. However, it is the interdental spaces where food lees are most likely to stay that need to be cleaned to prevent diseases. Therefore, attention has been paid in recent years to interdental tooth brushes or dental flosses that specifically clean the interdental spaces.

FIG. 8 shows one example of the interdental tooth brush which is one of the tooth cleaning appliances. A thin wire or plastic rod is provided as an axis at the forward end of a handle which is to be gripped by a hand. Bristles as seen in a plane perpendicular to the axis are planted radially and in the same length in all the directions. The brush has a cylindrical, conical or barrel-like shape when seen along the longitudinal axis thereof.

Since the bristles as seen in a plane perpendicular to the axis of the brush are planted radially and in the same length in all the directions, the known interdental tooth brush is very useful to an intact person whose teeth or gingivas are not defected remarkably or retracted or a person whose tooth condition is close to that of the intact person. However, it is not useful to a person if he or she has teeth or gingivas which have become unsound, i.e., if a person has gingival pockets or free gingivas (hereinafter referred to as gingival pockets) in which spaces are formed between the teeth and roots of the teeth due to periodontal disease or other diseases: it does not reach the inside of the gingival pockets because the bristles have a circular cross-section, making a sufficient degree of cleaning difficult.

SUMMARY OF THE INVENTION

In view of the above-described problems of the prior art, it is a primary object of the present invention to provide an interdental tooth brush in which the way in which bristles as seen in a plane perpendicular to the axis of a brush portion of the brush are planted is improved and in which the length of the bristles planted in the directions in which the interdental pockets are generated is made longer than that of the bristles in other directions so as to enable the bristles to reach all the portions of the interdental pockets when the brush is inserted between the interdental space.

A second object of the present invention is to provide an interdental tooth brush with an insertion guide which enables the cross-section of the brush to be well fitted into the interdental procket when the brush is inserted between the interdental space.

A third object of the present invention is to provide an interdental tooth brush which enables a liquid medicine to be sent between the interdental space while it is being cleaned by the interdental tooth brush so as to make the cleaning a complete one.

A fourth object of the present invention is to provide an interdental tooth brush in which the length of the bristles from the brush axis in a plane perpendicular to the brush axis are conditioned such that cleaning of the interdental pockets is facilitated.

A fifth embodiment of the present invention is to provide an interdental tooth brush whose handle has a flat cross-section which ensures that the long bristles are aligned in the direction in which the interdental pocket is generated when the handle is gripped and the brush is inserted between the interdental space in the longitudinal axis thereof.

The length of the bristles as seen in a plane perpendicular to the longitudinal axis of the brush is made longer in three directions according to the present invention. Therefore, it enables the interdental spaces of intact teeth to be cleaned when it is inserted therebetween. It can also sufficiently clean the contact points (portions at which individual teeth in each row make contact with approximal teeth mesially or centrifugally), periodontal pockets and gingival pockets by its longer bristles. The interdental tooth brush according to the present invention is provided with a means which enables the forward end thereof to be aligned with the interdental space while it is being inserted by being gripped at a brush handle. The interdental tooth brush enables a liquid medicine to be injected between the interdental space so as to make the cleaning with the brush more effective.

Thus, the interdental tooth brush according to the present invention enables the bristles of the brush to reach the interdental spaces of the intact teeth or teeth having interdental spaces between the gingivas and the tooth roots so as to clean them. The interdental tooth brush is provided with means which enables it to be used effectively by anybody.

BRIEF DESCRIPTION OF THE DRAWINGS

Other features and advantages of the invention will be apparent from the following description taken in connection with the accompanying drawings, wherein:

FIG. 2(*b*) is a side-elevational view of a brush shaped in another way;

FIG. 6(*b*) is a cross-sectional view of another example of the interdental tooth brush of FIG. 6(*a*);

FIG. 6(*c*) is a perspective view of still another example of the interdental tooth brush of FIG. 6(*a*);

DESCRIPTION OF THE PREFERRED EMBODIMENTS

Figure 1:
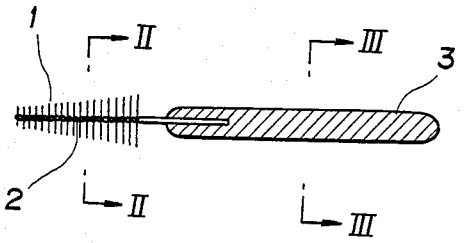
FIG. 1 is a section of side-elevational view of an interdental tooth brush, showing an embodiment of the present invention.
Figure 2A:
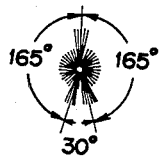
FIG. 2(*a*) is a cross-section taken along the line of II—II of FIG. 1 and seen when looking in the direction of the arrows.
Figure 2B:
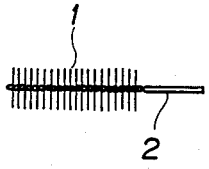

A first embodiment of the present invention will be described below with referencce to FIG. 1 which is a side-elevational view thereof, FIG. 2(*a*) which is a section taken along the line of II—II of FIG. 1 and seen when looking in the direction of arrows, and FIG. 3 which are sections taken along the line of III—III of FIG. 1 and seen when looking in the direction of arrows. The interdental tooth brush has bristles 1 made of nylon, pig bristles or raccoon dog bristles, a flexible wire or plastic core 2 which holds the bristles, and a handle 3. The bristles 1 as seen in a plane perpendicular to the longitudinal axis of a brush are held in the perpendicular directions (in the radial directions) with respect to the core 2. As seen in FIG. 1, the bristles are formed in a tapered fashion in the longitudinal direction of the core 2 so as to enable the interdental tooth brush to be easily inserted between the interdental space. FIG. 2(*b*) shows another example of the form of the bristles. The bristles of this example have the same length in the longitudinal direction of the core 2 and have a bar-like shape. Even if the bristles do not have a tapered shape, they fall in accordance with external force, so they can also be inserted between the interdental space without difficulty. As shown in FIG. 2(*a*), the bristles as seen in a plane perpendicular to the core 2 which are held radially with respect to the core 2 are formed in such a manner that the length thereof is made longer by about 2 mm in three directions which divide the circumference of the core 2 at about 165 degrees, 165 degrees and 30 degrees, respectively, i.e., that an isosceles triangle is formed.

Figures 3A, 3B, 3C, 3D:
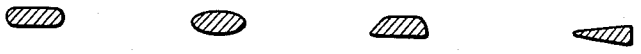
FIGS. 3(*a*)–3(*d*) show modifications of the cross-section taken along the line of III—III of FIG. 1 and seen when looking in the direction of the arrows.

FIG. 3 shows modifications of the flat cross-section of the handle 3 of the tooth brush of this embodiment. FIG. 3(*a*) shows a handle having a rectangular cross-section; FIG. 3(*b*) shows one which is elliptical in cross-sectional; FIG. 3(*c*) illustrates one which is trapezoidal in cross-section; and FIG. 3(*d*) shows a handle having an isosceles triangular cross-section.

When three patients who suffered from gingival atrophy experimentally used the tooth brush according to this embodiment for one week, not only the interdental spaces but also the gingival pockets could be sufficiently cleaned, and their gingivas became firm.

Figure 4:
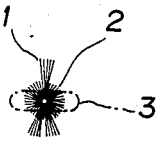
FIG. 4 is a front view of an essential part of an interdental tooth brush, showing another embodiment of the present invention.

A second embodiment of the present invention will be described below with reference to FIG. 4.

In this embodiment, bristles are mounted on a flat handle at a specific angle which ensures that the relatively longer bristles are directed in a direction in which a tooth brush of this embodiment is easily inserted between the interdental space when a brush handle 3 (indicated by an imaginary line) is picked up or gripped. The flat cross-section of this brush handle may be rectangular, elliptical, trapezoidal, isosceles triangular, or gourd-shaped. In other words, the brush handle may be in any form, so long as it enables a user to pick the tooth brush up in a specific direction.

In order to make the tooth brush a convenient one, the bristles are coupled to the handle in such a manner that the direction in which relatively longer bristles are planted and the longitudinal length of the handle coincides with or are perpendicular to each other. They may also be coupled to each other at an angle which is just between the above-described two directions.

Figure 5:
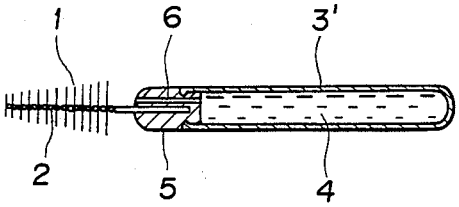
FIG. 5 is a sectional side elevation of an interdental tooth brush, showing still another embodiment of the present invention.

A third embodiment of the present invention will be now described with reference to FIG. 5. The tooth brush of this embodiment has a hollow handle 3′ made of an elastic material. The handle 3′ has a hollow portion 4 which contains a liquid medicine. An interdental tooth brush proximal portion 5 is fitted into the opening provided at one end of the handle 3′ in such a manner as to be removable and that it can hermetically seal the hollow portion 4. The tooth brush proximal portion has a supply hole 6 which passes therethrough and which communicates the hollow portion 4 with the external side through the proxial portion. An interdental tooth brush provided with this handle which contains a liquid medicine enables the interdental spaces to be cleaned physically. If the handle 3′ is pressed at that time so as to supply the liquid medicine to the affected part, it also enables chemical healing to be done. Therefore, the tooth brush of this embodiment is effective in healing the disease as well as cleaning the interdental spaces.

A fourth embodiment of the present invention will be described below with reference to FIG. 6.

Figure 6A:
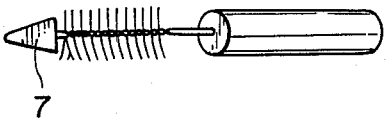
FIG. 6(*a*) is a perspective view of an interdental tooth brush, showing still another embodiment of the present invention.
Figure 6B:
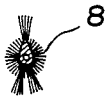
Figure 6C:
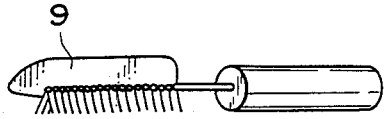

FIG. 6(*a*) is a perspective view thereof. A thin plate-like guide 7 is fixed to the distal end of the axis of the brush in such a manner that it is aligned with the relatively longer bristles planted in one direction when the bristles are seen in a plane perpendicular to the longitudinal axis of the brush, i.e, in such a manner that it is aligned with a plane determined by the relatively longer bristles planted in the vertical direction when the bristles are seen in the cross-section shown in FIGS. 2(*a*), 4 and 7. The guide 7 may have any cross-sectional shape including an isosceles triangle and an ellipse, so long as it enables the guide 7 to act as a guide when the brush is inserted between the interdental space, and determines the angle (the direction) at which the brush is inserted. The handle of the tooth brush in this embodiment may have a circular cross-section. It is preferable, however, for the peripheral surface of the handle to be provided with a mark or a recessed or protruded portion which is related with the longitudinal axis of the guide 7 so as to enable the user to know in which way the tooth brush is inserted.

FIG. 6(*b*) is a cross-sectional view of the axis of the brush, showing a modification of the guide 7. In this example, the guide 7 which is fixed to the distal end of the axis of the brush in the fourth embodiment is extended over the entire length of the axis of the brush so as to form a guide 8. The guide 8 has a thin plate-like shape, as the guide 7 does, which enables the tooth brush to enter between the interdental space.

FIG. 6(*c*) shows another modification of the guide 7 of the fourth embodiment shown in FIG. 6(*a*). The tooth brush of this example has a thin plate-like guide 9 which is extended only in one of the three directions in which the relatively longer bristles are planted, i.e., in the vertical direction in FIG. 2(*a*). In another two directions which are on the side of the gingival or gingival pocket, longer bristles are planted. In consequence, when the thin plate-like guide 9 which forms part of the tooth brush is inserted between the interdental space, it is guided by the space and thereby determines the direction in which the tooth brush is inserted in such a manner that the longer bristles can sufficiently reach the gingival or periodontal pocket.

Figure 7:
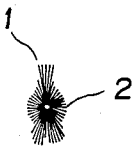
FIG. 7 is a front view of an interdental tooth brush, showing a modified example of bristles.
Figure 8:
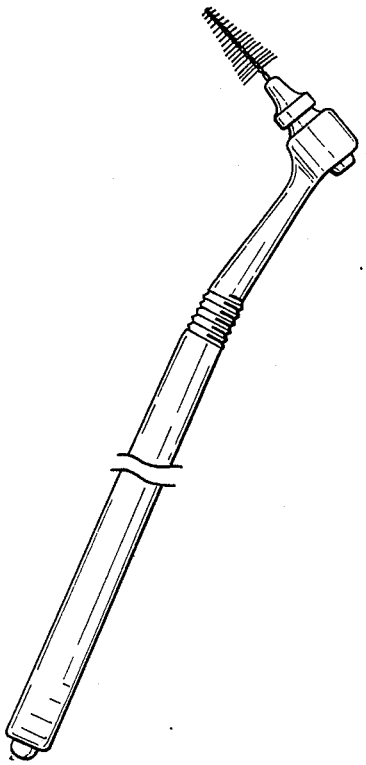
FIG. 8 PRIOR ART
FIG. 8 is a side-elevational view of a known interdental tooth brush.

In any of the above-described examples, the radially planted bristles may also be formed in such a manner that the length thereof varies as an angle on the circumference at which they are planted changes, as shown in FIG. 7. The length of the relatively longer bristles in one direction may be slightly shorter than that of the longer bristles in other two directions so as to enable the tooth brush to be used to clean the contact point as well as the gingival pocket. The cross-section of the longitudinal axis of the brush may be in a clyndrical or conical shape. Alternatively, it may be in the form in which the mid point has the largest thickness and the thickness gradually decreases toward the end. The bristles, the core of the brush portion, and handle may also be made of materials other than those described above.

While the invention has been particularly shown and described with reference to preferred embodiments thereof, it will be understood by those skilled in the art that the foregoing and other changes in form and details can be made therein without departing from the spirit and scope of the invention.

What is claimed is:

1. An elongated brush-like interdental tooth cleaning appliance for use in cleaning a space formed between adjacent teeth which includes a body of radially extending bristles having a longitudinal axis characterized in that three circumferentially spaced groups of the bristles as seen in a plane perpendicular to the longitudinal axis are radially longer than the remaining bristles.

2. A device as claimed in claim 1 wherein said groups of the bristles have respective radial center lines and angles between said center lines of about 165°, 165° and 30° respectively.

3. A device as claimed in claim 2 including a relatively wide flat handle at one end of said body, the handle having a width dimension which is set at a predetermined angle relative to said radial center lines.

4. An elongated brush-like interdental tooth cleaning appliance for use in cleaning space formed between adjacent teeth which includes a body of radial bristles with a longitudinal axis characterized in that the radial length of bristles as seen in a plane perpendicular to the longitudinal axis of said appliance varies circumferentially and is longer in three circumferentially spaced bristle groups than in the remainder of the bristles, and that one end of said appliance is provided with a guide for detecting the direction in which said appliance should be inserted.

5. An elongated brush-like interdental tooth cleaning appliance for use in cleaning a space formed between adjacent teeth having a body of radial bristles with a longitudinal axis characterized in that the radial length of bristles as seen in a plane perpendicular to the longitudinal axis of said appliance is longer in three circumferentially spaced bristle groups than in the remainder of the bristles, that the device has an elongate handle adjacent said body a liquid medicine is accommodated in a hollow formed in the handle of said appliance, said handle beig made of an elastic material that can be deformed, and that a small hole is formed in the vicinity of a brush mounting proximal portion of the handle so as to communicate said hollow and an external space adjacent the bristles.

* * * * *